US008324819B2

(12) United States Patent
Dahan

(10) Patent No.: US 8,324,819 B2
(45) Date of Patent: Dec. 4, 2012

(54) ELECTRIC APPLIANCE CONTROL

(76) Inventor: Daniela Dahan, Holon (IL)

( * ) Notice: Subject to any disclaimer, the term of this patent is extended or adjusted under 35 U.S.C. 154(b) by 371 days.

(21) Appl. No.: 12/484,344

(22) Filed: Jun. 15, 2009

(65) Prior Publication Data

US 2010/0019679 A1 Jan. 28, 2010

(30) Foreign Application Priority Data

Jul. 22, 2008 (IL) ..... 192947

(51) Int. Cl.
*H05B 37/02* (2006.01)

(52) U.S. Cl. ..... 315/158; 315/154; 315/151

(58) Field of Classification Search ..... 315/149–159
See application file for complete search history.

(56) References Cited

U.S. PATENT DOCUMENTS

| | | | | |
|---|---|---|---|---|
| 4,249,160 | A * | 2/1981 | Chilvers | 340/902 |
| 4,658,129 | A * | 4/1987 | Fan | 250/214 R |
| 5,552,676 | A * | 9/1996 | Viljanen | 315/151 |
| 6,114,813 | A * | 9/2000 | Lo et al. | 315/159 |
| 7,258,575 | B1 * | 8/2007 | Weng | 439/620.01 |
| 7,633,398 | B2 * | 12/2009 | DuFaux et al. | 340/602 |
| 2006/0250027 | A1 * | 11/2006 | Pasma | 307/140 |

FOREIGN PATENT DOCUMENTS

| | | |
|---|---|---|
| DE | 3140876 | 5/1982 |
| EP | 0067256 | 12/1982 |
| EP | 1339266 | 8/2003 |
| ES | 2171107 | 8/2002 |
| GB | 2204946 | 11/1988 |
| NZ | 516861 | 3/2004 |

* cited by examiner

*Primary Examiner* — Douglas W Owens
*Assistant Examiner* — Amy Yang
(74) *Attorney, Agent, or Firm* — Law Offices of Edward Langer

(57) ABSTRACT

In one aspect, the present invention is directed to an electric appliance control for turning off an electric appliance operating in an indoor space, the electric appliance control comprising: a light sensor, for continuously sensing the light intensity in the indoor space; a fall detector, for detecting a fall in the light intensity sensed by the light sensor, wherein the fall being a negative relative change in light intensity during a period of hundredths of second; a switch, for disconnecting the electrical power supply to the electric appliance; and a control unit, for activating the switch to disconnect the power supply upon detecting a fall in light intensity by the fall detector.

19 Claims, 6 Drawing Sheets

ELECTRIC APPLIANCE CONTROL

CROSS-REFERENCE TO RELATED APPLICATIONS

This application claims the benefit of Israel Patent Application No. IL 192947, filed 28 Jul. 2008, which is incorporated herein by reference.

FIELD OF THE INVENTION

The present invention relates to the field of control of electric appliances such as room heaters, air conditioners, and so on.

BACKGROUND OF THE INVENTION

Electric heating is any process in which electrical energy is converted to heat. Common applications include heating of buildings, cooking, and industrial processes.

An electric heater is an electrical appliance that converts electrical energy into heat. The heating element inside every electric heater is simply an electrical resistor, and works on the principle of Joule heating: an electric current flowing through a resistor converts electrical energy into heat energy.

When an electric heater is used for space heating, such as warming a bathroom or other "small" and confined area, a user, especially an elderly individual, may forget to turn off the heater. As a result, the power consumption is a vast waste, and furthermore, abandoning the heater without human observation can result in disaster.

It is an object of the present invention to provide an electric appliance that overcomes the above detailed drawbacks and other drawbacks of the prior art.

Other objects and advantages of the invention will become apparent as the description proceeds.

SUMMARY OF THE INVENTION

The following embodiments and aspects thereof are described and illustrated in conjunction with systems, tools methods, and so forth, which are meant to be merely illustrative, not limiting in scope.

In one aspect, the present invention is directed to an electric appliance control for turning off an electric appliance operating in an indoor space, the electric appliance control comprising:

- a light sensor, for continuously sensing the light intensity in the indoor space;
- a fall detector, for detecting a fall in the light intensity sensed by the light sensor, wherein the fall being a negative relative change in light intensity during a period of hundredths of second;
- a switch, for disconnecting the electrical power supply to the electric appliance; and
- a control unit, for activating the switch to disconnect the power supply upon detecting a fall in light intensity by the fall detector.

The control unit may be based on mechanical mechanism/electrometrical mechanism (such as that illustrated in FIG. 4), electronic mechanism (such as illustrated in FIG. 5), and so on.

The electric appliance control may further comprise a mechanism for manual reconnecting the electric appliance to an electrical power supply thereof.

According to one embodiment of the invention, the light sensor is a photoresistor.

According to another embodiment of the invention, the light sensor is a photoelectric cell.

In embodiments of the present invention, the switch comprises a second switch having at least connected and disconnected stable states, such as a bistable relay.

According to one embodiment of the invention, the second switch comprises:

- a manual selector having a connected state and a disconnected state; and
- an electric motor for turning the manual selector from the connected state to the disconnected state, upon receiving a command form the control unit.

Preferably, the electric appliance is a heating unit; however, it may also be an air conditioner, and actually, any electric consuming appliance, which serves no purpose if left operating without users in its immediate area.

The fall detector may comprise:

- a change sensor, for sensing change in light intensity; and
- a comparator, for generating an electric effect upon the change if indicating light fall.

The change sensor may make use of a capacitor, a coil, and so on, for indicating a change in light intensity.

In another aspect, the present invention is directed to a controlling method for turning off an electric appliance operating in an indoor space, the method comprising the steps of:

- continuously sensing light intensity in the indoor space; and
- upon detecting a fall in light intensity in the indoor space, disconnecting the electrical power supply to the electric appliance, wherein the fall being a negative relative change in light intensity during a period of hundredths of second.

The fall in light intensity may be detected by the steps of:

- converting light intensity to voltage;
- filtering a change in one direction of the voltage, wherein the direction indicates a fall of light intensity; and
- generating an electrical signal from the filtered voltage.

In addition to the exemplary aspects and embodiments described above, further aspects and embodiments will become apparent by reference to the figures and by study of the following detailed description.

BRIEF DESCRIPTION OF THE DRAWINGS

The objects and features of the present invention will become apparent from the following detailed description considered in conjunction with the accompanying drawings, in which.

Figure 1:
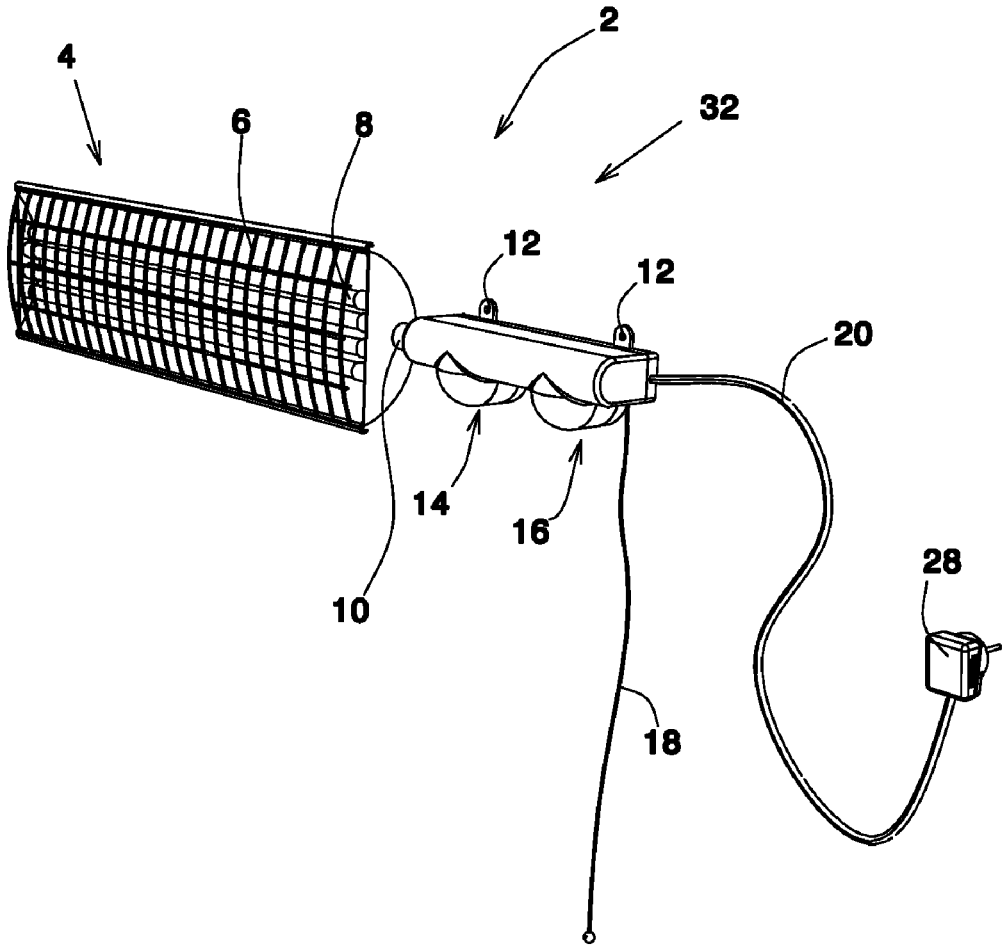
FIG. 1 schematically illustrates a bathroom heater, according to one embodiment of the invention.

It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, are merely intended to conceptually illustrate the structures and procedures described herein. Reference numerals may be repeated among the figures in order to indicate corresponding or analogous elements.

DETAILED DESCRIPTION OF THE INVENTION

In the following detailed description, numerous specific details are set forth in order to provide a thorough understanding of the invention. However, it will be understood by those skilled in the art that the present invention may be practiced without these specific details. In some instances, well-known methods, procedures, components and circuits have not been described in detail, for the sake of brevity.

FIG. 1 schematically illustrates a bathroom heater, according to one embodiment of the invention.

The heater, which is marked herein by numeral 2, comprises a heating unit 4, a switching unit 32 manually activated by a rope 18, and a plug 28 to the socket.

The term "fall in light level" (or "fall in light intensity") refers herein to a negative relative change in light intensity during a period of hundredths of second.

According to embodiments of the present invention, heating unit 4 includes a mechanism for turning off heating unit 4, except by rope 18, automatically if the user forgets to do so. The mechanism is based on detecting a fall in the light level.

In some cases, while the user forgets to turn off the bathroom heater, he remembers to turn off the bathroom light, since this is an operation activated by procedural memory.

Procedural memory, also known as implicit memory, is the long-term memory of skills and procedures, or "how to" knowledge (procedural knowledge). Different mechanisms and brain circuits govern it.

Examples of activities managed by procedural learning include riding a bike, driving a car, touch-typing, playing a musical instrument, swimming, and more, even simple verbal abilities like back-reading of text. Conditioned reflex is also an example of procedural memory.

In the event a user forgets to turn off the heater, but turns off the bathroom light in which the heater is installed, the heater too is turned off. As a result, not only electrical power is saved, but also the potentially dangerous situations inherent in leaving the heater on without supervision is averted.

Figure 5:
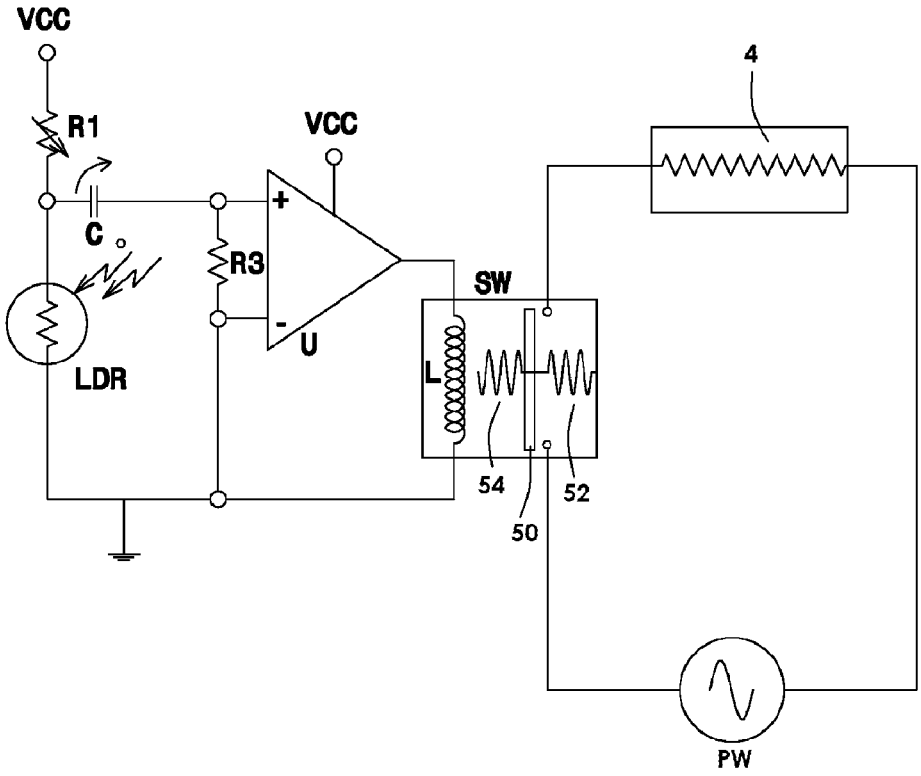
FIG. 5 is an electronic scheme of the circuitry of a switching unit of a heater, according to one embodiment of the invention.

FIG. 5 is an electronic scheme of a circuitry of a switching unit of a heater, according to one embodiment of the invention.

The circuitry shown by FIG. 5 is circuitry 36 in switching unit 32 of FIG. 1.

Circuitry 36 includes a light sensor LDR for sensing light intensity; a manual and controllable switch SW, which may be turned on and off manually by rope 18; and a fall detector, including the other components of the circuit, for detecting a fall in light intensity to disconnect switch SW.

A bistable relay is a relay having two stable states, when not energized. Momentary energizing power may toggle a bistable relay from one stable state to the other.

According to this embodiment switch SW is a manual switch which also includes a bistable relay, having a "left" state and a "right" state".

Manually moving leaf 50 of switch SW to the "right" state, which closes the circuit of heater 4 turning it to on, is stabilized by spring 52. Manually moving leaf 50 of switch SW to the "left" state, which opens the circuit of heater 4, turning it to off, is stabilized by spring 54.

Leaf 50 may be moved to the "left" state, for turning heater 4 to off, also by energizing solenoid L.

When light intensity is constant, both inputs of comparator U are grounded, such that the minus input is grounded directly and the plus is grounded through resistor R3, thus the output of comparator U does not energize coil L.

The light sensor may be based on photoresistor, photoelectric cell, and so on.

A photoelectric cell, or photovoltaic cell, is a device that converts light energy into electricity by the photovoltaic effect.

A photoresistor, or Light Dependent Resistor (LDR) cell, is an electronic component whose resistance decreases as incident light intensity increases. It can also be referred to as a photoconductor. The resistance of a photoresistor is a function of light intensity to which the photoresistor is exposed.

According to this embodiment, the light intensity sensor is a Light Dependent Resistor LDR, whose resistance is high for a low light level.

During a fall of light level, due to turning off the bathroom light, the voltage on the plus input of comparator U rises, through capacitor C, which is an example of a change sensor, as an element for sensing voltage change.

Since within this "short" period, the plus input voltage is higher than the ground of the minus input, comparator U provides a Vcc voltage, energizing coil L to turn heater 4 to off.

Comparator U compares only one direction of the change of light. When turning the lights on, voltage at the plus point decreases, but not beyond the ground of the minus input, thus not energizing coil L. According to another embodiment, coil L cannot move leaf 50 to the "right" state.

Figure 2:
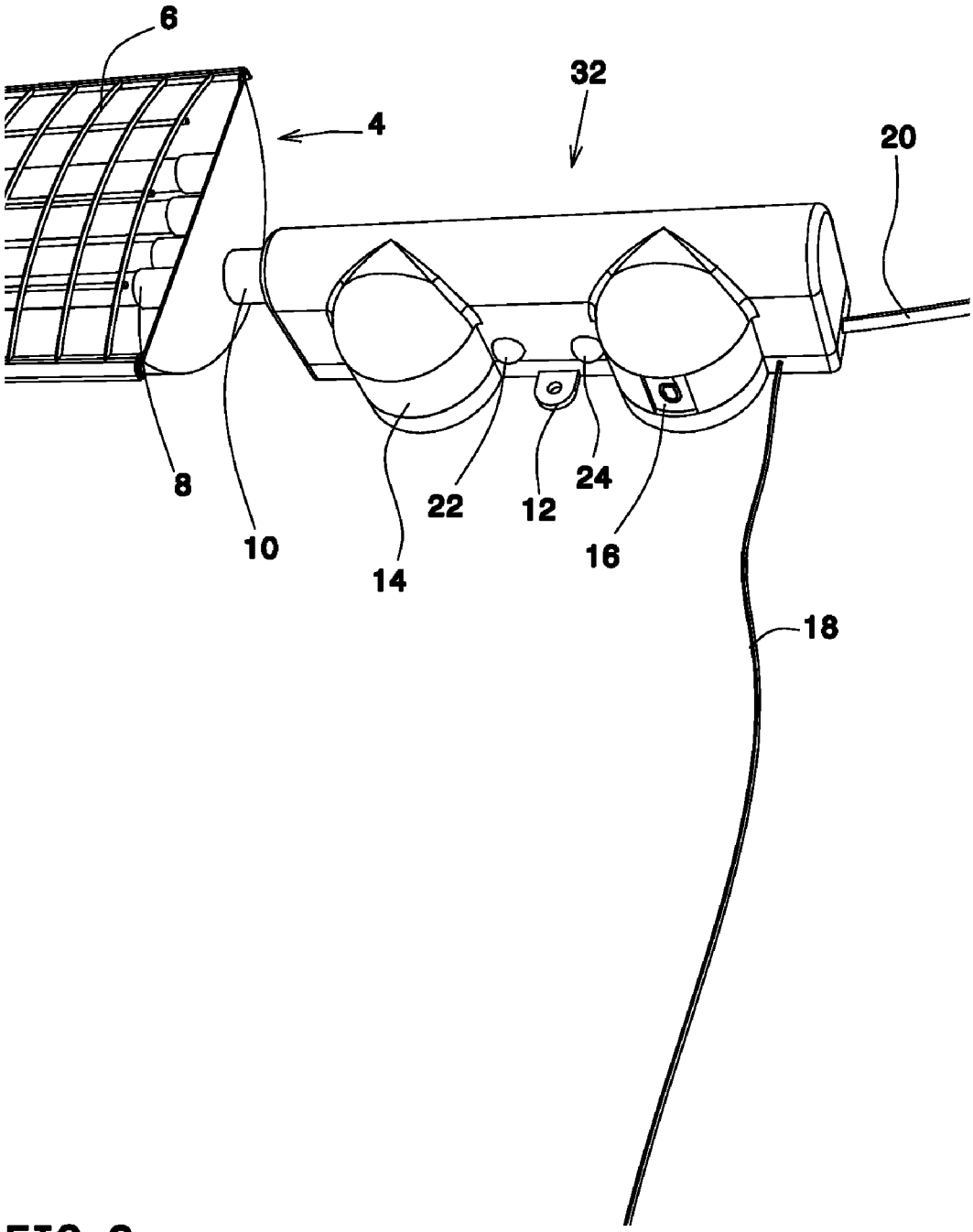
FIG. 2 is a zoomed view of the switching unit 32 of the bathroom heater 2 of FIG. 1.

FIG. 2 is a zoomed view of switching unit 32 of bathroom heater 2 of FIG. 1.

Figure 3:
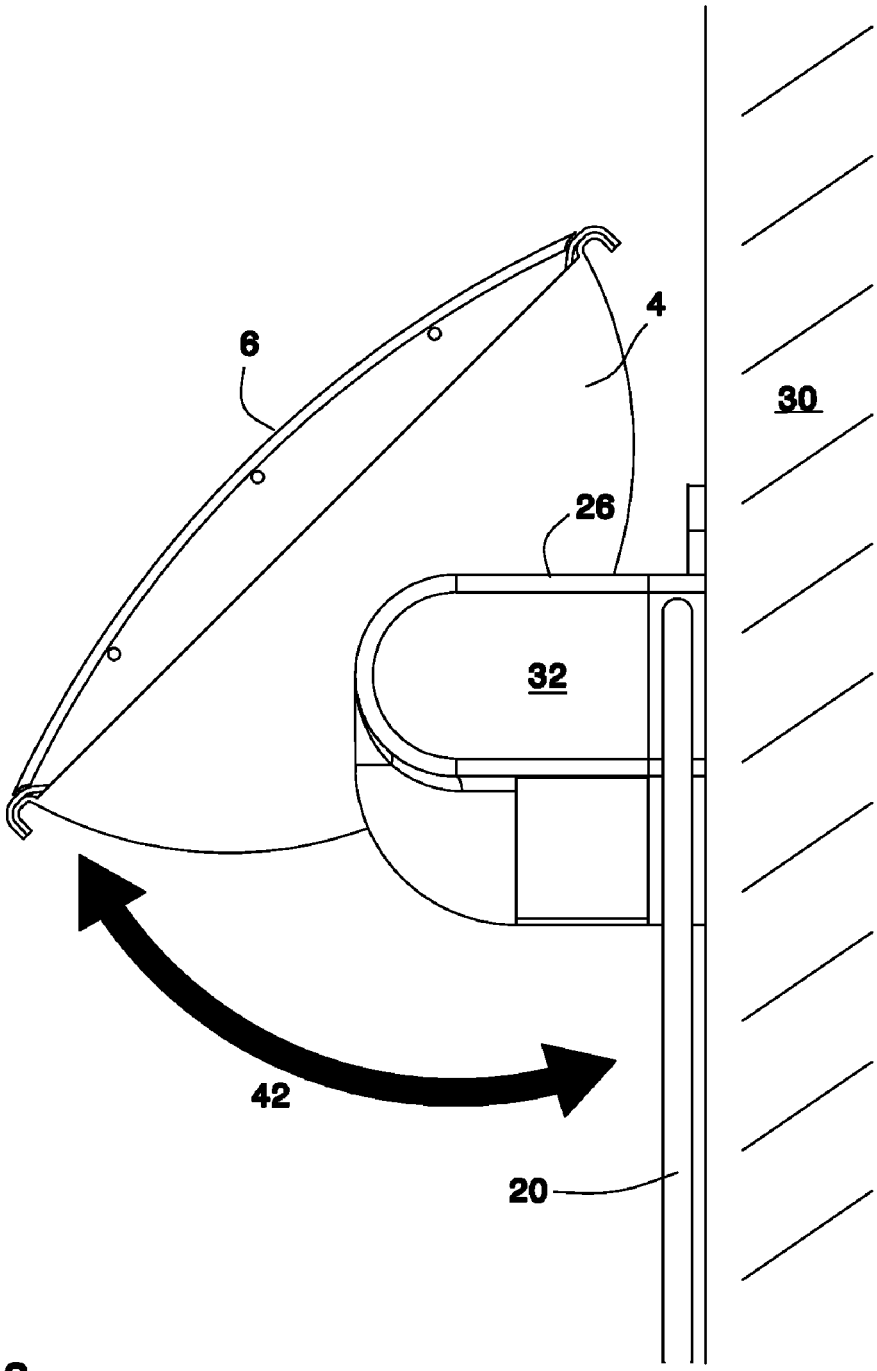
FIG. 3 is a side view of the bathroom heater of FIG. 1.

FIG. 3 is a side view of the bathroom heater of FIG. 1.

Figure 4:
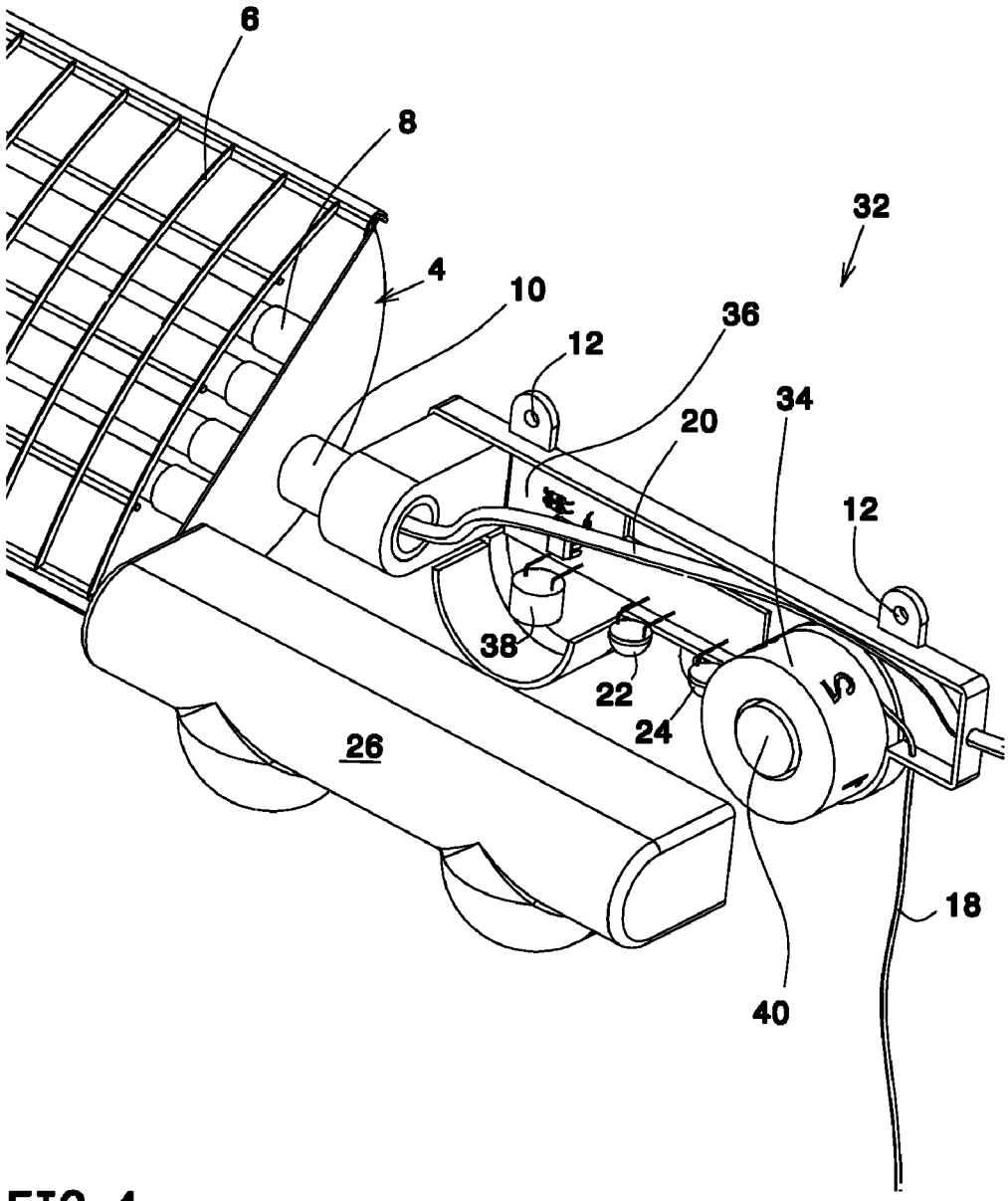
FIG. 4 is a side view, which schematically illustrates the interior side of switching unit 32 of the heater of FIG. 1.

FIG. 4 is a side view, which schematically illustrates the interior side of switching unit 32 of the heater of FIG. 1.

Heating unit 4 comprises four heating elements 8. The heating level of the heater is selected by rotating selector 34 by rope 18. Thus, selector 34 is a knob rotatable by rope 18.

For example, when a user pulls the rope down one inch, the first heating unit is turned on; when the user pulls the rope down two inches, the first and the second heating units are turned on; and so forth.

However, upon pulling the rope beyond the last level of the selector, electrical motor 40 rotates the knob backwards, until it reaches the off state thereof. In this state, the heating unit is turned off. The detection that the knob was rotated beyond the last heating level can be carried out by a limit switch. A limit switch can also be used for signaling the switching unit to stop the backward rotation of the motor.

The text on the lower side of wheel 34 indicates the heating level: "0" indicates an off state, "1" indicates the first heating level, "2" indicates the second heating level, and so on.

According to another embodiment, switch SW of FIG. 5 may be selector 34, which may also be rotated, upon sensing a fall in light intensity by motor 40 until reaching the off-state thereof.

According to this embodiment of the invention, in the event of detecting a fall in light intensity sensed by light sensor 38, which may be LDR of FIG. 5, circuitry 36 rotates selector 34 towards its off state. The rotation can be stopped, for example, by a limit switch.

Figure 6:
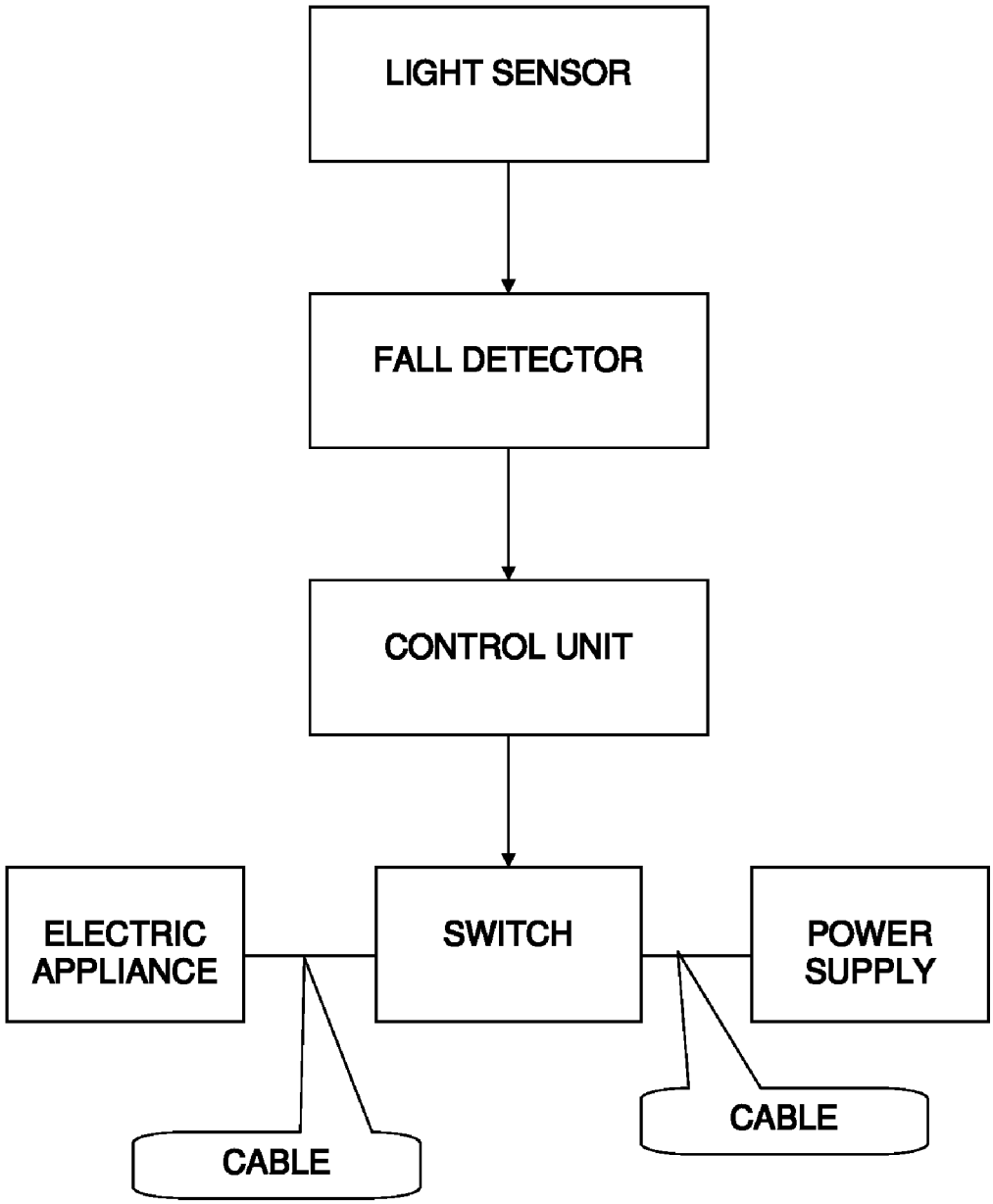
FIG. 6 is a block diagram, which schematically illustrates the logical modules of an electric appliance control, according to one embodiment of the invention.

FIG. 6 is a block diagram, which schematically illustrates the logical modules of an electric appliance control, according to one embodiment of the invention.

A light sensor continuously senses the light intensity at the indoor space where the electric appliance is deployed. The light sensor is marked herein by the symbol LDR, A fall detector detects a fall in the light intensity sensed by the light sensor. In the examples herein, the fall detector is a part of the circuit illustrated in FIG. 5.

A switch connects and disconnects the power supply to the electric appliance.

The switch is controlled by a control unit, which is a mechanism that activates the switch to disconnect the power supply to the appliance. For example, when the control unit receives an input signal from the fall detector that indicates a fall in the light intensity, it activates the switch to disconnect the power supply from the electric appliance.

The control unit may be based on a mechanical/electromechanical mechanism (such as that illustrated in FIG. 4, which rotates the knob selector), electric/electronic mechanism, such as that illustrated in FIG. 5, and so on.

Preferably, the control unit comprises means for manual reconnecting the electric appliance to the power supply thereof, after being disconnected. For example, the mechanical mechanism illustrated in FIG. 4 turns the knob to its off state, in which the power supply is disconnected. Reconnecting the power supply is carried out by manually turning the knob to its heating state. In the embodiment of FIG. 5, the leaf 50 is used as means for manual reconnecting the power supply to the electric appliance.

In the examples herein, embodiments of the invention have been illustrated with reference to a heater; however, it should be noted that a heater is only one specific case of an electrical device, and the present invention may be implemented on any other electrical device, such as an air conditioner, television set, and so on.

In the figures and description herein, the following numerals and symbols have been mentioned:

numeral 2 denotes a bathroom heater, according to one embodiment of the invention;
numeral 4 denotes a heating unit;
numeral 6 denotes a protection grill;
numeral 8 denotes an electrical resistor;
numeral 10 denotes an axle, for changing the deployment angle of heating unit 4;
numeral 12 denotes a hanging hole;
numeral 14 denotes a housing of a light sensor;
numeral 16 denotes a selector (selecting knob);
numeral 18 denotes an operating rope;
numeral 20 denotes an electric cable;
numeral 22 denotes a green control lamp (when lit it indicates that the heater is on);
numeral 24 denotes a red control lamp (when lit it indicates that the heater is off);
numeral 26 denotes a cover of a circuitry;
numeral 28 denotes an electrical plug;
numeral 30 denotes a wall on which heater 2 is hung;
numeral 32 denotes a switching unit;
numeral 34 denotes a selector implemented as a wheel rotated by rope 18;
numeral 36 denotes a circuitry for detecting light fall;
numeral 38 denotes a light sensor;
numeral 40 denotes an electric motor which returns wheel 4 to the "0" state thereof;
numeral 42 denotes an arrow illustrating a rotational movement to adjust heating unit 4 to a desired angle;
symbol Vcc denotes input power to the circuitry;
symbol R1 denotes an adjustable resistor;
symbol R3 denotes a resistor;
symbol LDR denotes a light dependent resistor;
symbol C denotes a capacitor;
symbol U denotes a comparator;
symbol L denotes a coil;
symbol SW denotes a switch, which may include a relay;
numeral 50 denotes a leaf of a relay; and
each of numerals 52 and 54 denotes a spring in the relay.

While certain features of the invention have been illustrated and described herein, the invention can be embodied in other forms, ways, modifications, substitutions, changes, equivalents, and so forth. The foregoing description of the embodiments of the invention has been presented for the purposes of illustration and description. It is not intended to be exhaustive or to limit the invention to the precise form disclosed. Many modifications and variations are possible in light of this disclosure. It is intended that the scope of the invention be limited not by this detailed description, but rather by the claims appended hereto.

What is claimed is:

1. An electric appliance control, for automatically turning off an electric appliance operating in an indoor space, the electric appliance control consisting of:

a light sensor, for continuously sensing the light intensity in said indoor space;

a fall detector, for detecting a fall in the light intensity sensed by said light sensor, wherein said fall being a negative relative change in light intensity during a period of hundredths of a second;

a switch, for disconnecting the electrical power supply to said electric appliance; and a control unit, having a single voltage comparator for sensing voltage change via at least one of a capacitor and a coil, wherein only during a fall in the light intensity, said comparator provides a voltage energizing a coil for activating said switch to disconnect said power supply upon detecting a fall in light intensity by said fall detector, thereby also providing proper operation in an indoor surrounding lighted by an outdoor light source.

2. An electric appliance control according to claim 1, wherein said control unit is based on a mechanical mechanism.

3. An electric appliance control according to claim 1, wherein said control unit is based on an electromechanical mechanism.

4. An electric appliance control according to claim 1, wherein said control unit is based on an electronic mechanism.

5. An electric appliance control according to claim 1, further comprising a mechanism for reconnecting the power supply to said electric appliance, after being turned off as a result of detecting a fall in light intensity.

6. An electric appliance control according to claim 5, wherein said control unit is based on manual operation.

7. An electric appliance control according to claim 1, further comprising a mechanism for manually connecting and disconnecting of said electric appliance from an electrical power supply thereof.

8. An appliance control according to claim 1, wherein said light sensor is a photoresistor.

9. An appliance control according to claim 1, wherein said light sensor is a photoelectric cell.

10. An appliance control according to claim 1, wherein said switch comprises a second switch having at least stable connected and disconnected states.

11. An appliance control according to claim 10, wherein said second switch comprises a bistable relay.

12. An appliance control according to claim 10, wherein said second switch comprises:

a manual selector having a connected state and a disconnected state; and an electric motor for turning said manual selector from said connected state to said disconnected state, upon receiving a command from said control unit.

13. An appliance control according to claim 1, wherein said electric appliance is a heating unit.

14. An appliance control according to claim 1, wherein said electric appliance is an air conditioning unit.

15. An appliance control according to claim 1, wherein said fall detector comprises:

a change sensor, for sensing change in said light intensity; and a comparator, for generating an electric effect upon said change if indicating light fall.

16. An appliance control according to claim 15, wherein said change sensor comprises an element selected from a group comprising: capacitor, coil.

17. An electric appliance control according to claim 1, wherein an operating level of said electric appliance is determined by a rotating selector.

18. An electric appliance control according to claim 17, wherein said switch rotates said selector upon detecting a fall in light intensity by said fall detector.

19. An electric appliance control, for automatically turning off an electric appliance operating in an indoor space, the electric appliance control comprising:

a light sensor consisting of a Light Dependent Resistor having a high resistance for a low light level, for continuously sensing the light intensity in said indoor space;

a fall detector, for detecting a fall in the light intensity sensed by said light sensor, wherein said fall being a negative relative change in light intensity during a period of hundredths of second;

a switch, for disconnecting the electrical power supply to said electric appliance; and a control unit, wherein during a fall in the light intensity, voltage on a plus input of a comparator rises, whereby, since the plus input voltage is higher than ground of the minus input, said comparator provides a voltage energizing a coil for activating said switch to disconnect said power supply upon detecting a fall in light intensity by said fall detector.

* * * * *